US005862237A

United States Patent [19]

Kishigami et al.

[11] Patent Number: 5,862,237

[45] Date of Patent: Jan. 19, 1999

[54] SPEAKER APPARATUS

[75] Inventors: Jun Kishigami, Saitama; Masao Fujihira, Kanagawa; Takahiro Muraguchi, Tokyo, all of Japan

[73] Assignee: Sony Corporation, Tokyo, Japan

[21] Appl. No.: 872,134

[22] Filed: Jun. 10, 1997

[30] Foreign Application Priority Data

Jun. 18, 1996 [JP] Japan ..... 8-177520

[51] Int. Cl.[6] ..... H04R 3/00

[52] U.S. Cl. ..... 381/117; 381/111

[58] Field of Search ..... 381/117, 111, 381/116, 401–2, 406, 124, 152, 185, 104, 109

[56] References Cited

U.S. PATENT DOCUMENTS

| | | | |
|---|---|---|---|
| 4,515,997 | 5/1985 | Stinger, Jr. | 381/116 |
| 4,555,797 | 11/1985 | Nieuwendijk et al. | 381/401 |
| 4,566,120 | 1/1986 | Nieuwendijk et al. | 381/401 |
| 4,612,420 | 9/1986 | Nieuwendijk et al. | 381/117 |
| 5,003,609 | 3/1991 | Muraoka | 381/117 |
| 5,303,371 | 4/1994 | Nakajima | 381/109 |
| 5,347,587 | 9/1994 | Takahashi et al. | 381/117 |
| 5,592,559 | 1/1997 | Takahashi et al. | 381/111 |

FOREIGN PATENT DOCUMENTS

| | | | |
|---|---|---|---|
| 56-131294 | 10/1981 | Japan | H04R 3/00 |
| 57-138293 | 8/1982 | Japan | H04R 3/00 |
| 57-185793 | 11/1982 | Japan | H04R 3/00 |
| 57-186898 | 11/1982 | Japan | 381/117 |
| 58-19027 | 2/1983 | Japan | 381/117 |
| 59-34795 | 2/1984 | Japan | 381/117 |
| 59-207799 | 11/1984 | Japan | 381/109 |
| 61-206397 | 9/1986 | Japan | H04R 9/04 |

*Primary Examiner*—Curtis A. Kuntz
*Assistant Examiner*—Xu Mei
*Attorney, Agent, or Firm*—Jay H. Maioli

[57] ABSTRACT

A speaker device driving drive coils of a speaker such as an electromagnetically coupled speaker by digital sound signals, where a primary coil of the speaker unit is constituted by 15 pieces of coils, the coils are made to correspond to respective bits excluding MSB of a digital sound of 16 bits issued from a serial/parallel converter, each of the coils are connected in a bridge connection to 4 pieces of FETs respectively opposed to each other and constant current sources are connected to the bridge connection portions whereby a coil drive circuit is constituted, currents from the constant current sources are respectively supplied to the coils and a variable resistor is adjusted by which voltages are changed and the currents of the constant current sources are commonly controlled whereby the volume of the speaker is finely driven.

4 Claims, 6 Drawing Sheets

FIG. 5

| CURRENT | MSB | 2 SB | 3 SB | 4 SB | 5 SB | 6 SB | 7 SB | 8 SB | 9 SB | 10 SB | 11 SB | 12 SB | 13 SB | 14 SB | 15 SB | LSB |
|---|---|---|---|---|---|---|---|---|---|---|---|---|---|---|---|---|
| + | 0 | 1 | 1 | 1 | 1 | 1 | 1 | 1 | 1 | 1 | 1 | 1 | 1 | 1 | 1 | 1 |
| | 0 | 1 | 1 | 1 | 1 | 1 | 1 | 1 | 1 | 1 | 1 | 1 | 1 | 1 | 1 | 0 |
| | 0 | 1 | 1 | 1 | 1 | 1 | 1 | 1 | 1 | 1 | 1 | 1 | 1 | 1 | 0 | 1 |
| | 0 | 1 | 1 | 1 | 1 | 1 | 1 | 1 | 1 | 1 | 1 | 1 | 1 | 1 | 0 | 0 |
| | | | | | | | | | | | | | | | | |
| | 0 | 0 | 0 | 0 | 0 | 0 | 0 | 0 | 0 | 0 | 0 | 0 | 0 | 0 | 1 | 1 |
| | 0 | 0 | 0 | 0 | 0 | 0 | 0 | 0 | 0 | 0 | 0 | 0 | 0 | 0 | 1 | 0 |
| | 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 0 | 0 |
| | 1 | 1 | 1 | 1 | 1 | 1 | 1 | 1 | 1 | 1 | 1 | 1 | 1 | 1 | 1 | 0 |
| | 1 | 1 | 1 | 1 | 1 | 1 | 1 | 1 | 1 | 1 | 1 | 1 | 1 | 1 | 0 | 1 |
| | 1 | 1 | 1 | 1 | 1 | 1 | 1 | 1 | 1 | 1 | 1 | 1 | 1 | 1 | 0 | 0 |
| | | | | | | | | | | | | | | | | |
| | 1 | 0 | 0 | 0 | 0 | 0 | 0 | 0 | 0 | 0 | 0 | 0 | 0 | 0 | 1 | 1 |
| | 1 | 0 | 0 | 0 | 0 | 0 | 0 | 0 | 0 | 0 | 0 | 0 | 0 | 0 | 1 | 0 |
| | 1 | 0 | 0 | 0 | 0 | 0 | 0 | 0 | 0 | 0 | 0 | 0 | 0 | 0 | 0 | 1 |
| − | 1 | 0 | 0 | 0 | 0 | 0 | 0 | 0 | 0 | 0 | 0 | 0 | 0 | 0 | 0 | 0 |
| COIL | | IP | IN | IM | IL | IK | IJ | II | IH | IG | IF | IE | ID | IC | IB | IA |

SPEAKER APPARATUS

BACKGROUND OF THE INVENTION

1. Field of the Invention

The present invention relates to a speaker apparatus such as an electromagnetically coupled speaker apparatus.

2. Description of Related Art

As a sound reproducing speaker, there has been known and reduced into practice an electromagnetically coupled speaker apparatus where a magnet is interposed between a center pole portion and a plate provided at a yoke by which a magnetic circuit having an air gap between the center pole portion and the plate is constituted, a primary coil that is a drive coil is fixed to the center pole portion or the plate in the air gap of the magnetic circuit and a secondary coil constituting a short coil is arranged in the air gap of the magnetic circuit by fixing the secondary coil to a vibrating plate such that the secondary coil is opposed to the primary coil.

According to the electromagnetically coupled speaker, secondary current is induced in the secondary coil constituting a short coil by signal current flowing in the primary coil that is a drive coil and a drive force in accordance with the secondary current is caused in the secondary coil by a mutual action of the secondary current in respect of magnetic fluxes caused in the air gap portion of the magnetic circuit based on Flemming's left hand law by which the vibrating plate fixed with the secondary coil is displaced. Voice is generated by moving the vibrating plate in such a manner.

According to the electromagnetically coupled speaker, the primary coil where the signal current flows, is provided with advantages where it is excellent in heat radiating performance and is durable to large input since it is fixed to the center pole portion or the plate constructed of a magnetic material such as iron. Further, distortion can be minimized by constituting the secondary coil which constitutes a short coil by a cylindrical body of one turn constructed of a nonmagnetic electrically conductive material, for example, aluminum.

Incidentally, as a speaker, a dynamic speaker where a voice coil bobbin is arranged to fix to a vibrating plate in an air gap of a magnetic circuit and a voice coil which is a drive coil is wound around the voice coil bobbin, or the like has been reduced into practice.

According to a speaker such as an electromagnetically coupled speaker or a dynamic speaker described above, it is conceivable to reproduce voice by providing, for example, coils of several bits of digital voice signals as drive coils and by driving the respective coils by the respective bits of signals in correspondence with the respective bits of the digital voice signals.

For example, when input digital sound signals are linear quantized signals of 16 bits in an electromagnetically coupled speaker, the primary coil of the electromagnetically coupled speaker is constituted by 16 pieces of coils, the turn numbers of the respective coils are made to correspond to the weights of respective bits of input digital voice signals, the turn number of each coil is twice as much as that of a contiguous coil corresponding to a bit at an order lower than the order of the each coil by 1. Further, when bits of the input digital voice signals corresponding to the respective coils become active, currents having a constant current value are made to flow.

The drive force F of a vibration system in an electromagnetically coupled speaker, is represented by $F=BLi$ that is a product of a secondary current i induced in the secondary coil, the density of magnetic fluxes B generated in an air gap of a magnetic circuit and a length L of the secondary coil disposed in the air gap of the magnetic circuit where the magnetic flux density B and the length L are constant, and accordingly, the drive force F of the vibration system is proportional to the secondary current i induced in the secondary coil. The secondary current i induced in the secondary coil is proportional to a product of a signal current flowing in the primary coil and the turn number (impedance) of the primary coil.

Accordingly, when the electromagnetically coupled speaker is constructed as mentioned above, the vibrating plate where the secondary coil is fixed, is displaced in one direction by an amount in proportion to the weights of the respective bits of the input digital sound signals and voice is reproduced honestly in compliance with the input digital sound signals.

In the meantime, it is necessary for a speaker device to change the sound volume. That is, in the case where the drive coil of a speaker such as an electromagnetically coupled speaker or a dynamic speaker, is directly driven by digital sound signals as described above, it is conceivable as a system of controlling the sound volume that the drive coil of the speaker is constituted by coils having a number that is larger than the number of bits of the input digital sound signals and driving coils are switched by the input digital sound signals in accordance with a desired sound volume.

For example, in respect of an electromagnetically coupled speaker, when the input digital sound signals are constituted by 16 bits, the primary coils of the electromagnetically coupled speaker is constituted by 24 pieces of coils, the turn numbers of the respective coils are changed in a geometric series as described above and in order to obtain a maximum sound volume, 16 pieces of the coils on the side of larger turn numbers are driven by the digital sound signals of 16 bits and in order to obtain a minimum sound volume, 16 pieces of coils on the side of smaller turn numbers are driven by 16 bits of the input digital sound signals.

However, according to this system, the drive coils having a number that is larger than the number of bits of the input digital sound signals, are needed, a total of the turn numbers of the drive coils are considerably increased, the structure of speaker is complicated and fabrication cost is increased. Further, the system is provided with inconvenience where the stages of sound volume control are restricted by the number of drive coils such as 8 stages according to the above-described example.

Therefore, according to the present invention, the sound volume of a speaker can finely be controlled by a speaker structure that is simple and is fabricated at a low cost in the case where drive coils of a speaker such as an electromagnetically coupled speaker are driven by digital sound signals.

SUMMARY OF THE INVENTION

According to a first aspect of the present invention, there is provided a speaker device including a speaker unit and a speaker drive circuit, the speaker drive circuit further including a plurality of drive sources for supplying drive currents to drive coils of the speaker unit respectively in correspondence with respective bits excluding a highest bit of input digital voice signals supplied to the speaker drive circuit or respective bits including the highest bit, and a volume adjusting unit for adjusting a volume of a sound reproduced by the speaker unit by commonly controlling the drive currents supplied from the plurality of drive sources to the drive coils.

According to a second aspect of the present invention, there is provided a speaker device including a speaker unit, and a speaker drive circuit, the speaker drive circuit including a plurality of drive sources for supplying drive currents to drive coils of the speaker unit respectively in correspondence with respective bits excluding a highest bit of input digital sound signals supplied to the speaker drive circuit or respective bits including the highest bit, and a volume adjusting unit for adjusting a volume of a sound reproduced by the speaker unit by commonly controlling ratios of time periods where the drive currents are supplied from the plurality of drive sources to the drive coils to time periods where the drive currents are not supplied from the plurality of drive sources to the drive coils in one sampling period of the input digital sound signals.

According to the speaker device in the first aspect or the second aspect of the present invention, the drive currents supplied from the plurality of drive sources of the speaker drive circuit to the drive coils of the speaker unit, are commonly controlled, or the ratios of the time periods where the drive currents are supplied from plurality of drive sources of the speaker drive circuit to the drive coils of the speaker unit, to the time periods where the drive currents are not supplied from the drive sources to the drive coils of the speaker unit in one sampling period of the input digital sound signals, are commonly controlled by which the volume of the sound reproduced by the speaker unit is adjusted.

Accordingly, a number of drive coils having a number that is more numerous than the bit number of input digital sound signals, are not needed a total of the turn numbers of the drive coils may remain at a small number and the volume can be controlled finely and continuously.

BRIEF DESCRIPTION OF THE DRAWINGS

FIG. 5 is a diagram showing a relationship between input digital sound signals and primary coils of the speaker apparatus of FIG. 1 or FIG. 2;

DETAILED DESCRIPTION OF PREFERRED EMBODIMENTS

Figure 1:
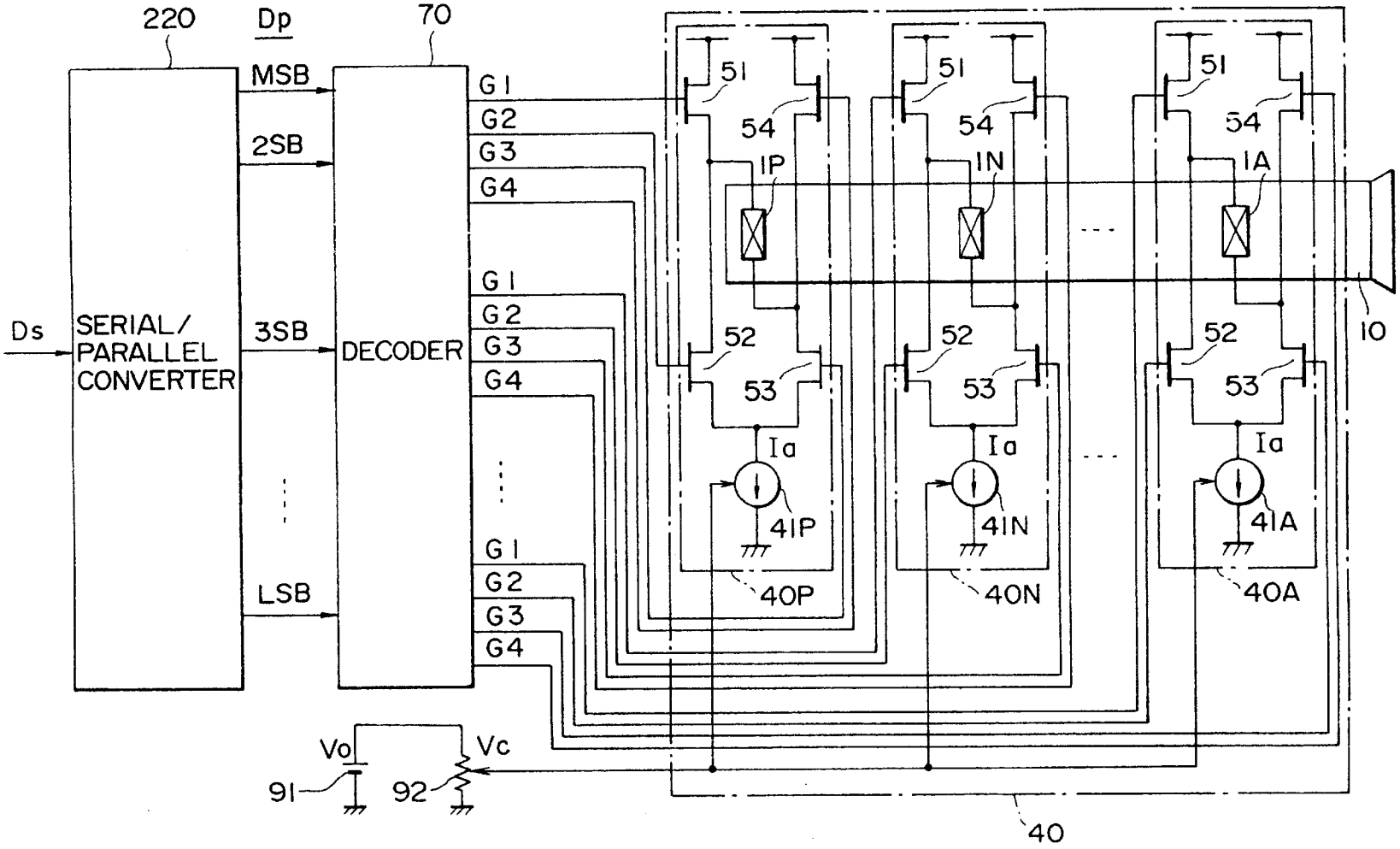
FIG. 1 is a connection diagram showing an example of a speaker apparatus according to the present invention.

FIG. 1 shows an example of a speaker apparatus according to the present invention where in a serial/parallel converter 220, digital sound signals Ds of serial data which are digitized into 16 bits by a sampling frequency of, for example, 44.1 kHz or 48 kHz , are converted into digital sound signals Dp of parallel data. Incidentally, according to this example, the digital sound signals Ds and Dp of 16 bits, are digitized by compliment codes of 2's as shown by FIG. 5 and in a linear manner.

Figure 6:
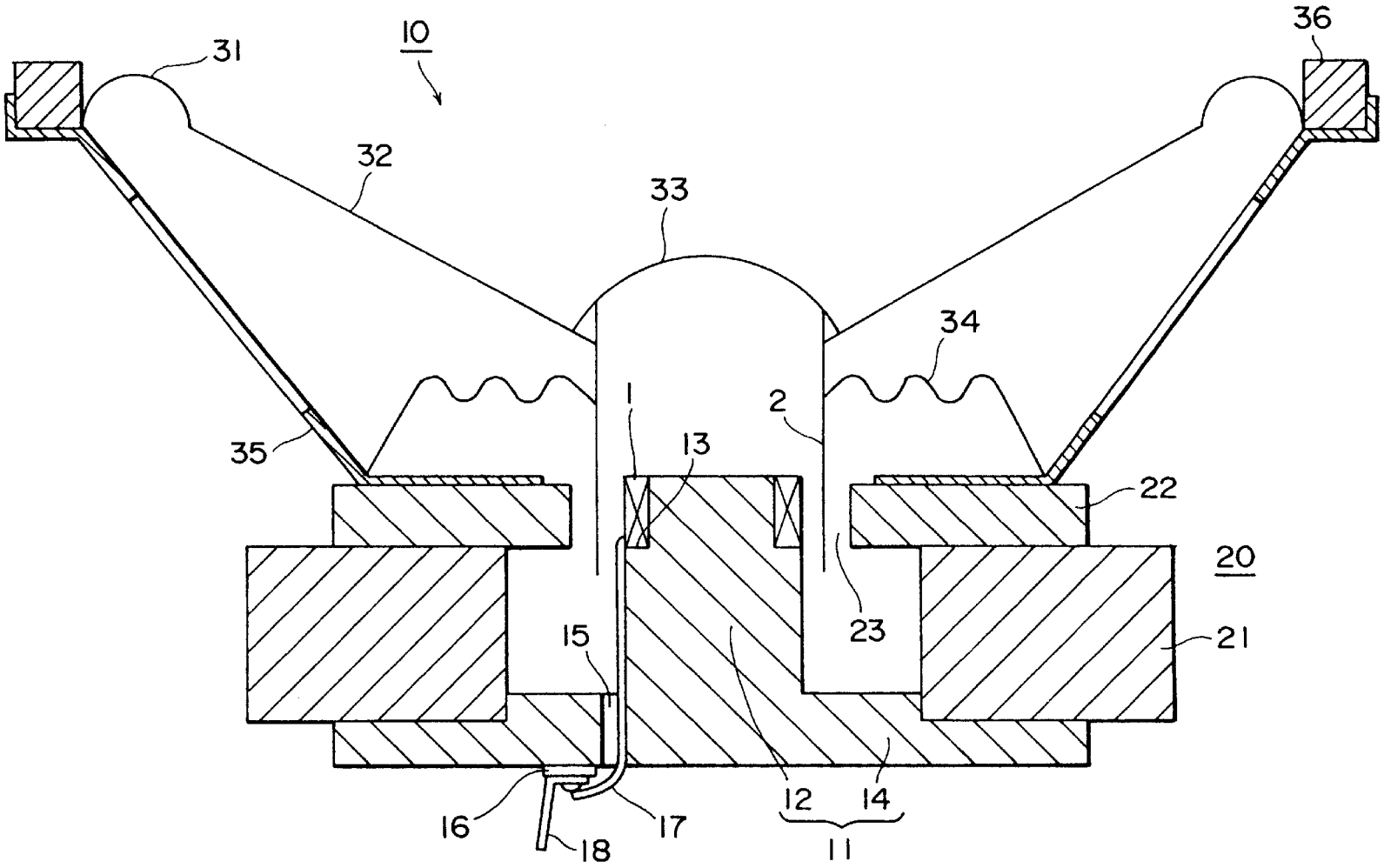
FIG. 6 is a sectional view showing an example of a speaker unit of the speaker apparatus of FIG. 1 or FIG. 2.

A speaker unit 10 is constructed of an electromagnetically coupled speaker. FIG. 6 shows an example of the speaker unit 10 where a recess 13 is formed at a surrounding of a frond end portion of a center pole portion 12 in a yoke 11 where the center pole portion 12 and a bottom flange portion 14 are integrally formed and a primary coil 1 that is a drive coil, is attached to the center coil portion 12 by being fitted to the recess 13.

The primary coil 1 is attached to the center pole portion 12 by being wound in a cylindrical shape and press-fitted and adhered to the recess 13. Or, although not illustrated, it is attached to the center pole portion 12 when it is wound into a magnetic bobbin and the magnetic bobbin is press-fitted and adhered to the recess 13. Or, it is attached to the center pole portion 12 by being wound directly at the recess 13.

An opening 15 is formed in the bottom flange portion 14 of the yoke 11 at a position proximate to the center pole portion 12 and a terminal plate 16 is attached onto the back face of the bottom flange portion 14. Further, coil lead-out lines 17 comprising, for example, cotton covered wires of a primary coil 1 are adhered to the peripheral face of the center pole portion 12, inserted into the opening 15 and are connected to input terminals 18 on the terminal plate 16 by soldering.

The coil lead-out lines 17 are respectively provided at a portion of the primary coil 1 for starting winding and a portion thereof for finishing winding and are connected to separate ones of the input terminals. Further, when the primary coil 1 is constituted by a plurality of coils as mentioned later, the coil lead-out lines 17 of the respective coils are adhered onto the peripheral face of the center pole portion 12, inserted into the opening 15 and connected to the input terminals 18 on the terminal plate 16.

A magnet 21 is adhered onto the front face of the bottom flange portion 14 of the yoke 11 and a plate 22 is adhered onto the front face of the magnet 21 and a magnetic circuit 20 having an air gap 23 is formed between the outer peripheral face of the front end portion of the center pole portion 12 and the inner peripheral face of the plate 22.

A secondary coil 2 constituting a short coil is inserted into the air gap 23 of the magnetic circuit 20. The secondary coil 2 is constituted by a cylindrical body of 1 turn comprising a nonmagnetic electrically conductive material, for example, aluminum by which a bobbin wound around the secondary coil 2 can be dispensed with.

The inner peripheral portion of a cone 32 attached with an edge 31 at its outer peripheral portion, inner peripheral portions of a center cap 33 and a damper 34 are attached to the secondary coil 2 respectively, by, for example, an adhesive agent. A speaker frame 35 is attached to the plate 22, the edge 31 of the outer peripheral portion of the cone 32 and a gasket 36 are attached to the speaker frame 35 and the outer peripheral portion of the damper 34 is attached to the speaker frame 35.

However, although not illustrated, portions of coils of the primary coil may be attached onto the peripheral face at the front end portion of the center pole portion 12 and remaining coils may be attached onto the inner peripheral face of the plate 22. In this case, coil lead-out lines of the coils attached to the plate 22, are inserted, for example, between the plate 22 and the magnet 21 and are connected to input terminals on a terminal plate attached onto the outer peripheral face of the plate 22. Further, all of the primary coils may be attached onto the inner peripheral face of the plate 22.

Figure 7:
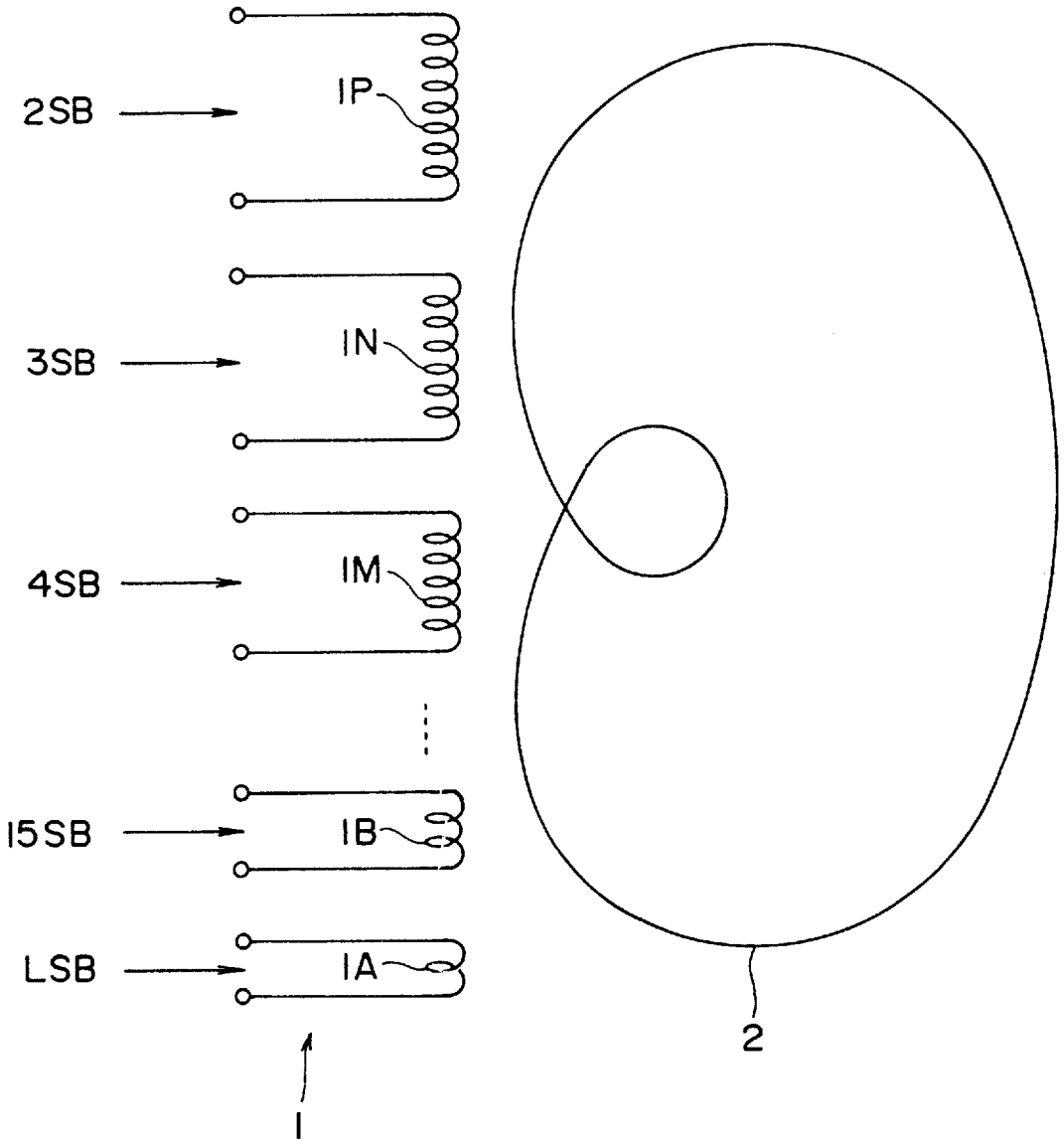
FIG. 7 is a diagram showing the coil structure of the speaker unit in the speaker apparatus of FIG. 1 or FIG. 2.

When the digital voice signals Dp of 16 bits from the serial/parallel converter 220 of FIG. 1, are quantized by the 2's compliment codes shown by FIG. 5 and in a linear manner, as described above, with MSB (uppermost bit) as a sign bit, as illustrated by FIG. 5 and FIG. 7, the primary coil 1 is constituted by 15 of coils 1A, 1B, . . . . ,1N, 1P, the coil 1A is made to correspond to LSB (lowermost bit) of the digital voice signals Dp, the coil 1A is provided with, for example, 2 turns. With respect to the remaining portions, the coils 1B, 1C, 1D, lE, 1F, 1G, 1H, 1I, 1J, 1K, 1L, 1M, 1N and 1P are made to correspond to 15SB, 14SB, 13SB, 12SB, 11SB, 10SB, 9SB, 8SB, 7SB, 6SB, 5SB, 4SB, 3SB, and 2SB and the respective coils are provided with 4 turns, 8 turns, 16 turns . . . where the turn number of a coil is twice as much as the turn number of another coil corresponding to a bit which is disposed lower than a bit of the former coil by 1 in respect of the order.

As shown by FIG. 1, coil drive circuits 40A through 40N, 40P are respectively provided to the coils 1A through 1N, 1P as a speaker drive circuit 40. According to each of the coil drive circuits 40A through 40N, 40P, each of constant current sources 41A through 41N, 41P and 4 FETS (Field Effect Transistor) 51 through 54 each as a switching element and each of corresponding ones of the coils 1A through 1N, 1P are connected in a bridge connection. When FETs 51 and 53 are made ON and FETs 52 and 54 are made OFF, a current Ia of a corresponding one of the constant current sources is made to flow to a corresponding one of the coils in the plus direction. When FETs 51 and 53 are made OFF and FETs 52 and 54 are made ON, the current Ia of the corresponding one of the constant current sources is made to flow to the corresponding one of the coils in the minus direction.

All of currents of the constant current sources 41A through 41N, 41P are set to an equal current value as designated by the current Ia. When all of FETs 51 through 54 are made ON or OFF in the same coil drive circuit, current is not made to flow in the corresponding one of the coils.

Further, the digital voice signals Dp from the serial/parallel converter 220 are supplied to a decoder 70. In respect of the decoder 70, in correspondence with 15 of the coils 1A through 1N, 1P of the primary coil 1, that is, in correspondence with 15 bits of the digital voice signals Dp excluding MSB, 4 of control signals G1 to G4, mentioned later, are respectively provided from MSB and corresponding lower bits (LSB through 2SB) of the digital voice signals Dp. The control signals G1 through G4 are supplied to gates of FETs 51 through 54 in the corresponding coil drive circuits 40A through 40N, 40P of the speaker drive circuit 40.

In respect of 4 of the control signals G1 through G4, when MSB of the digital voice signals Dp from the serial/parallel converter 220 is provided with a value of 0 and a corresponding one of the lower bits is provided with a value of 1, the control signals G1 and G3 are changed to a level whereby FETS 51 and 53 are turned ON and the control signals G2 and G4 are changed to a level whereby FETs 52 and 54 are turned OFF. When MSB is provided with a value of 0 and a corresponding one of the lower bits is provided with a value of 0, or when MSB is provided with a value of 1 and a corresponding one of lower bits is provided with a value of 1, the control signals G1 through G4 are changed to a level by which FETs 51 through 54 are turned OFF. When MSB is provided with a value of 1 and a corresponding one of the lower bits is provided with a value of 0, the control signals G1 and G3 are changed to a level whereby FETs 51 and 53 are turned OFF and the control signals G2 and G4 are changed to a level whereby FETs 52 and 54 are turned ON.

Accordingly, when MSB of the digital voice signals Dp is provided with a value of 0, the current Ia is made to flow to one of the primary coils corresponding to a lower bit in the plus direction only when the lower bit is provided with a value of 1. Conversely, when MSB is provided with a value of 1, the current Ia is made to flow to one of the primary coil corresponding to a lower bit in the minus direction only when the lower bit is provided with a value of 1.

As mentioned above, the drive force F of the vibration system of the electromagnetically coupled speaker is proportional to the secondary current i induced in the secondary coil and the secondary current i is proportional to the product of the signal current flowing in the primary coil and the turn number (impedance) of the primary coil.

Further, according to the above-described example, the turn numbers of the respective coils 1A through 1P of the primary coil 1 are set to turn numbers in proportion to the weights of the respective bits of the digital voice signals Dp excluding MSB from the serial/parallel converter 220 whereby, when the current Ia is made to flow as a signal current in a certain coil of the primary coil, a secondary current having a current value in proportion to the weight of a bit corresponding to the certain coil of primary coil is induced in the secondary coil, in a direction in correspondence with a value of MSP of the digital voice signals Dp from the serial/parallel converter 220.

Therefore, the cone 32 fixed with the secondary coil 2, is displaced by an amount in proportion to the weight of the bit corresponding to the primary coil, in a direction in accordance with a value of MSB of the digital voice signals Dp of the serial/parallel converter 220 and voice is reproduced honestly in correspondence with the digital voice signals Dp from the serial/parallel converter 220 in the speaker unit 10.

Further, according to this example, a power source 91 for adjusting sound volume and a variable resistor 92 for adjusting which takes out a voltage by dividing a voltage Vo from the power source 91 are installed and the voltage Vc obtained from the variable resistor 92 is supplied commonly to the constant current sources 41A through 41N, 41P of the coil drive circuits 40A through 40N, 40P and the current Ia of the constant current sources 41A through 41N, 41P is commonly controlled by the voltage Vc.

In this case, for example, the voltage Vo is set to 1V(volt), when the voltage Vc is maximized to 1V, the current Ia is maximized to 1A (ampere) and by adjusting the voltage Vc in a range of 1V or less, the current Ia is changed linearly or under a predetermined relationship in respect of the voltage Vc in a range of 1A or less.

Accordingly, by controlling the voltage Vc by adjusting the variable resistor 92, the current Ia of the constant current sources 41A through 41P can be commonly changed by which sound volume of voice reproduced by the speaker unit 10 can be controlled. Further, in this case a number of primary coils which are more numerous than the bit number of the input digital voice signal Ds or Dp, are not needed, a total of the turn numbers of the primary coil 1A through 1P can remain in a small number and further, the sound volume can be controlled finely and continuously.

Generally speaking, although an electromagnetically coupled speaker is excellent in heat radiating performance, durable to large input and can reduce distortion, the electromagnetically coupled force formed by inducing the secondary current in the secondary coil by the signal current flowing in the primary coil, is reduced in a lower region of several kHz to 1 kHz or lower and reproduction up to 20 Hz that is necessary for reproducing sound is difficult. Accordingly, the electromagnetically coupled speaker is conventionally used as a speaker for mainly reproducing high sound.

However, the digital voice signals Dp from the serial/parallel converter 220 of FIG. 1, are digitized by a sampling frequency of, for example, 44.1 kHz or 48 kHz and accordingly, the coils 1A through 1P are driven by digital signals having the same sampling frequency and therefore, low region components of sound signals before digitizing such as in a range of several kHz to 1 kHz or lower, are provided with high frequencies exceeding 20 kHz as the signal currents flowing in the coils 1A through 1P.

Accordingly, the reproduction of sound up to the low region can be accomplished by the speaker unit 10 that is the electromagnetically coupled speaker and a full range speaker reproducing from low sound to high sound can be realized.

Incidentally, similar to a general speaker, the vibration system of the speaker unit 10 is difficult to react with high sound region and especially, almost no components of high frequencies exceeding 20 kHz can be reproduced. Therefore, even if the coils 1A through 1P are driven by the digital signals having a sampling frequency of 44.1 kHz or 48 kHz, almost no frequency components thereof are reproduced. Even if the components are reproduced by a very small sound pressure, almost no sound exceeding 20 kHz is audible to human ear and therefore, no hindrance is caused in listening to a music or the like. Also, it is easy to intentionally form a mechanical filter with a cutting band region of 20 kHz or more and integrate it to the speaker unit 10.

Furthermore, a speaker device which does not use a D/A (Digital/Analog) converter and a power amplifier, which reproduces sound directly in accordance with digital sound signals and which has no distortion and a large maximum output, can be realized.

According to the speaker device in the example of FIG. 1, the sound volume can be controlled finely and continuously, a number of drive coils having a number more numerous than the bit number of digital sound signals, are not needed, and a total of turn numbers of drive coils may be a small number as described above.

Incidentally, in respect of the example of FIG. 1, the sound volume may be controlled by changing currents flowing in the coils 1A through 1P by changing the impedance of FETs 51 through 54 by changing the gate bias of FETs 51 through 54 of the coil drive circuits 40A through 40P without changing the current Ia of the constant current sources 41A through 41P.

Figure 2:
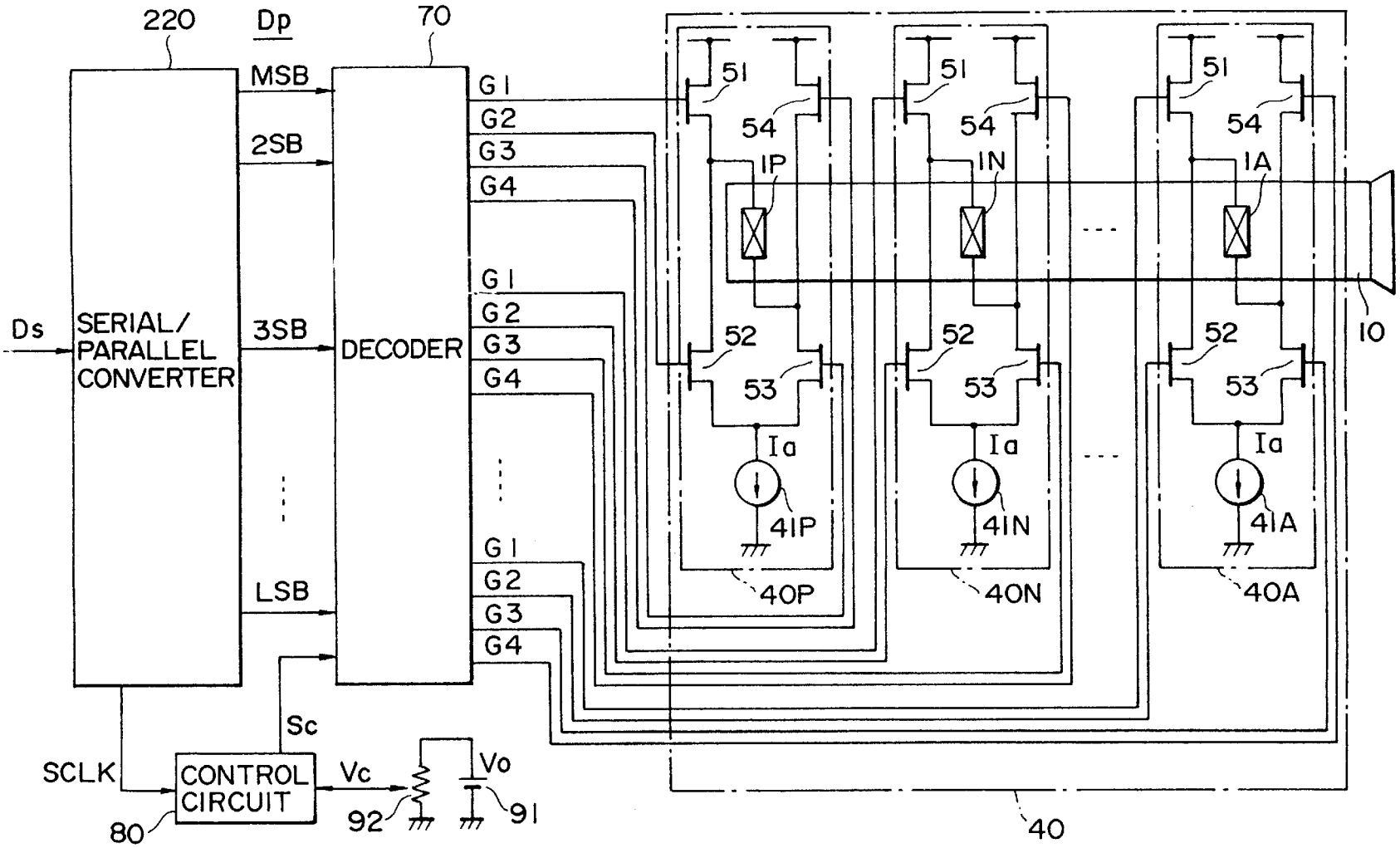
FIG. 2 is a connection diagram showing other example of a speaker apparatus according to the present invention.

FIG. 2 shows other example of a speaker device according to the present invention. According to the example, in respect of the serial/parallel converter 220, a sampling clock SCLK is extracted from the serial data of the digital sound signals Ds and the sampling clock SCLK is supplied to a control circuit 80 for adjusting sound volume. Also, the power source 91 for adjusting sound volume and the variable resistor 92 for adjusting which takes out the voltage by dividing the voltage Vo from the power source 91, are provided and the voltage Vc obtained from the variable resistor 92 is supplied to the control circuit 80.

In respect of the control circuit 80, a control signal Sc where a pulse width of the sampling clock SCLK is modulated by the voltage Vc, is obtained and the control signal Sc is supplied to a decoder 70.

Figure 3:
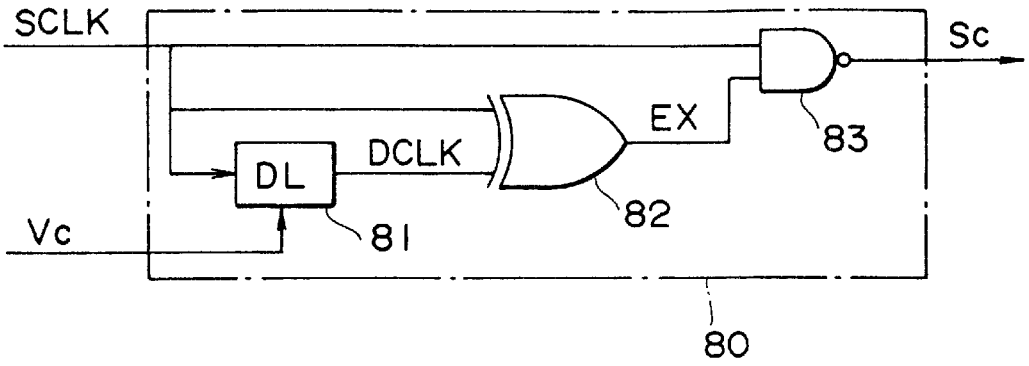
FIG. 3 is a connection diagram showing an example of a control circuit of the speaker apparatus of FIG. 2.

FIG. 3 shows an example of the control circuit 80 where the sampling clock SCLK from the serial/parallel converter 220 and a delay clock DCLK that is delayed by a delay circuit 81, are supplied to an Exclusive Or circuit 82 and an output signal EX from the Exclusive Or circuit and the sampling clock SCLK, are supplied to a NAND circuit 83 and an the output signal from the NAND circuit 83 is taken out as the above-described control signal Sc.

Here, a delay time Tx at the delay circuit 81 can be changed in a range of from 0 to ½ of a sampling frequency Ts of the digital sound signals Dp from the serial/parallel converter 220 by the voltage Vc obtained from the variable resistor 92.

Figure 4:
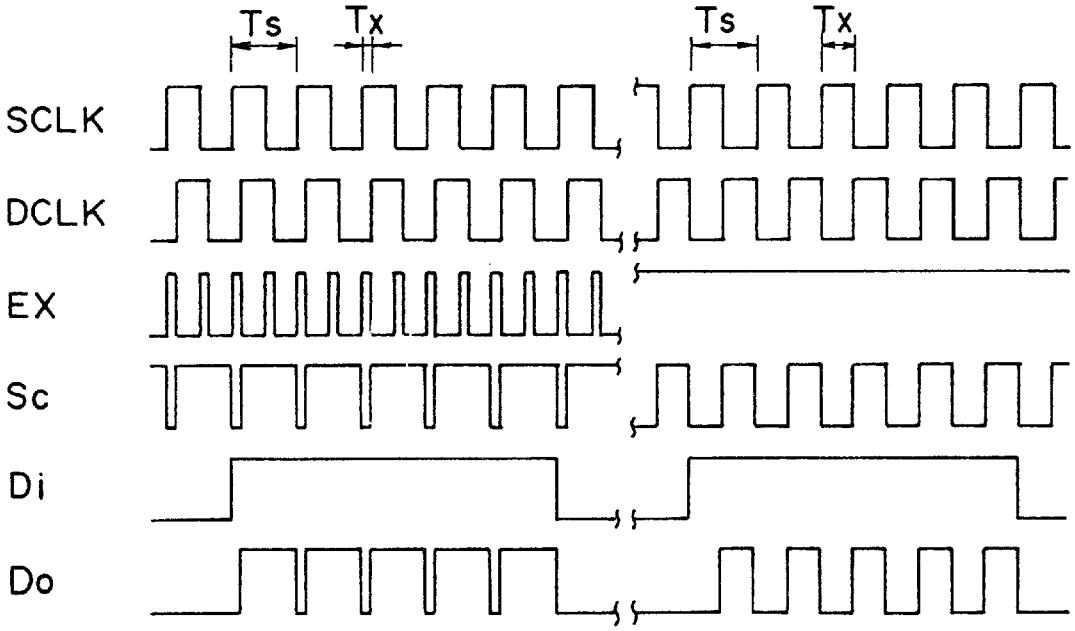
FIG. 4 is a diagram for explaining operation of the control circuit of FIG. 3.

Accordingly, when the delay time Tx is made to be very small, as shown by the left hand side of FIG. 4, the output signal EX from the Exclusive Or circuit 82 becomes a high level only in a time period twice as much as the very small delay time Tx in the period of the sampling frequency Ts of the digital sound signals Dp and the control signal Sc that is the output signal from the NAND circuit 83 becomes a high level in a time period excluding the time period of the very fine delay time Tx in the period of the sampling frequency Ts of the digital sound signals Dp.

By contrast, when the delay time Tx is set to a maximum time that is equal to ½ of the sampling period Ts of the digital sound signals Dp, as shown by the right hand side of FIG. 4, the output signal EX from the Exclusive Or circuit 82 becomes always the high level in the period of the sampling period Ts of the digital sound signals Dp and the controls signal Sc that is the output signal from the NAND circuit 83 becomes the high level in the period of the sampling period Ts of the digital sound signals Dp only at a time period of ½ of the sampling period Ts.

According to the decoder 70, the signals of the respective bits excluding MSB of the digital sound signals Dp from the serial/parallel converter 220, are taken out as the original data per se when MSB is 0 and when MSB is 1, they are taken out as original data which are reverted. That is, in respect of the decoder 70, the digital sound signals Dp which are 2's compliment codes as shown by FIG. 5 from the serial/parallel converter 220, are converted into reflected binary codes.

Further, signals that are produced by logical products of the signals of the respective bits excluding MSB of the digital sound signals which have been converted into the reflected binary codes, and the control signal Sc obtained from the control signal 80, are provided for the respective bits and the control signals G1 through G4 are formed from the signals of the logical products.

Therefore, when a signal of a certain bit excluding MSB of the digital sound signals which have been converted into the reflected binary codes, is as illustrated by a signal Di in FIG. 4, a signal of a logical product of the signal Di and the control signal Sc obtained from the control circuit 80, becomes as illustrated by a signal Do in FIG. 4.

That is, when the delay time Tx of the delay circuit 81 is made to be very small by adjusting the control voltage Vc by the variable resistor 92, as shown by the left hand side of FIG. 4, with respect to the original active time period, the signal Do becomes active in a time period excluding the period of the small delay time period Ts in the period of sampling period Ts of the digital sound signals. When the delay time Tx in the delay circuit 81 is made to be a maximum time that is equal to ½ of the sampling period Ts of the digital sound signals, as shown by the right hand side of FIG. 4, in respect of the original active time period, the signal Do becomes active within the period of the sampling period Ts of the digital sound signals only at time periods that are equal to ½ of the sampling period Ts.

Accordingly, by controlling the voltage Vc by adjusting the variable resistor 92, a ratio of a time period where the current Ia is supplied from the constant current sources 41A through 41P to the coils 1A through 1P within the sampling period Ts of the digital sound signals Dp from the serial/parallel converter 220, to a time period where the current Ia is not supplied thereto, can commonly be changed whereby the sound volume of voice reproduced by the speaker unit 10 can be controlled. Furthermore, a number of the primary coils having a number more numerous than a bit number of the input digital sound signals Ds or Dp, are not needed, a total of turn numbers of the primary coils 1A through 1P can remain at a small number and the sound volume can be controlled finely and continuously.

Although according to the example shown by FIG. 1 or FIG. 2, the turn numbers of the respective coils 1A through 1P constituting the primary coil 1, are constituted by the turn numbers in proportion to the weights of the respective bits excluding MSB of the digital sound signals Dp from the serial/parallel converter 220 by which differences in the weights of the respective bits of the digital sound signals Dp are reproduced, the turn numbers of the respective coils 1A through 1P may remain the same and the current values of the constant current sources 41A through 41P of the corresponding coil drive circuits 40A through 40P, may be changed by which differences in the weights of the respective bits of the digital sound signals Dp from the serial/parallel converter 220 can be reproduced and further, the sound volume can also be controlled as mentioned above.

When the differences in the weights of the respective bits of the digital sound signals are reproduced by changing the current values of constant current sources, components of the primary coil 1 can be unified into a single coil by switching the coil drive circuits 40A through 40P per se shown by FIG. 1 or FIG. 2 by signals of the respective bits excluding MSB of the digital sound signals.

Furthermore, the differences in the weights of respective bits of the digital sound signals can also be reproduced by combining the differences in the turn numbers of the plurality of primary coils and the differences in the current values of the plurality of constant current sources.

The present invention is also applicable to the case where the input digital sound signals are natural binary codes. The present invention is also applicable to the case where drive coils of a speaker such as a dynamic speaker are driven by digital sound signals.

As described above, according to the present invention, when drive coils of a speaker such as an electromagnetically coupled speaker are driven by digital sound signals, the sound volume of the speaker can be controlled finely by a simple speaker structure that is obtained at a low cost.

What is claimed is:

1. A speaker device comprising:

a speaker unit having drive coils; and a speaker drive circuit including:

a plurality of drive sources for supplying drive currents to said drive coils of said speaker unit, respectively, in correspondence with one of respective bits excluding a highest bit of input digital voice signals supplied to said speaker drive circuit and respective bits including the highest bit of the input digital voice signals; and a volume adjusting unit for adjusting a volume of a sound reproduced by said speaker unit by commonly controlling the drive currents supplied from said plurality of drive sources to said drive coils.

2. The speaker device according to claim 1, wherein said speaker unit comprises an electromagnetically coupled speaker wherein primary coils forming said drive coils are arranged in a vicinity of an air gap of a magnetic circuit of said electromagnetically coupled speaker and a secondary coil fixed to a vibrating plate of sa id electromagnetically coupled speaker and constituting a short coil is arranged in said air gap.

3. A speaker device comprising:

a speaker unit having drive coils; and a speaker drive circuit including:

a plurality of drive sources for supplying drive currents to said drive coils of said speaker unit, respectively, in correspondence with one of respective bits excluding a highest bit of input digital sound signals supplied to said speaker drive circuit and respective bits including the highest bit of the input digital sound signals;

a volume adjusting unit for adjusting a volume of a sound reproduced by said speaker unit by commonly controlling ratios of time periods during which the drive currents are supplied from said plurality of drive sources to said drive coils to time periods where the drive currents are not supplied from said plurality of drive sources to said drive coils during one sampling period of the input digital sound signals.

4. The speaker device according to claim 3, wherein said speaker unit comprises an electromagnetically coupled speaker having primary coils forming said drive coils in a vicinity of an air gap of a magnetic circuit of said electromagnetically coupled speaker and a secondary coil fixed to a vibrating plate of said electromagnetically coupled speaker and constituting a short coil is arranged in said air gap.

* * * * *